US012781145B2

(12) United States Patent
Yamazaki et al.

(10) Patent No.: US 12,781,145 B2
(45) Date of Patent: Nov. 3, 2026

(54) BIOMASS GASIFICATION FURNACE

(71) Applicant: SINTOKOGIO, LTD., Nagoya (JP)

(72) Inventors: Takuro Yamazaki, Nagoya (JP); Masanori Shimizu, Nagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 581 days.

(21) Appl. No.: 18/454,197

(22) Filed: Aug. 23, 2023

(65) Prior Publication Data

US 2024/0093104 A1 Mar. 21, 2024

(30) Foreign Application Priority Data

Sep. 16, 2022 (JP) ..... 2022-147484

(51) Int. Cl.
*C10J 3/32* (2006.01)
*C10J 3/72* (2006.01)

(52) U.S. Cl.
CPC ..... *C10J 3/32* (2013.01); *C10J 3/723* (2013.01); *C10J 2300/0916* (2013.01); *C10J 2300/0956* (2013.01); *C10J 2300/1246* (2013.01)

(58) Field of Classification Search
CPC ..... C10J 3/32; C10J 3/723; C10J 2300/0916; C10J 2300/0956; C10J 2300/1246
See application file for complete search history.

(56) References Cited

U.S. PATENT DOCUMENTS 4,095,960 A * 6/1978 Schuhmann, Jr. ..... C10J 3/08 48/DIG. 2
2007/0003459 A1* 1/2007 Stadlbauer ..... C10J 3/32 422/219
2009/0260286 A1 10/2009 Sasauchi et al.
2012/0256130 A1* 10/2012 Bell ..... C10K 3/008 422/198

(Continued)

FOREIGN PATENT DOCUMENTS

DE 10 2015 013 937 A1 5/2017
EP 3650518 A1 * 5/2020 ..... C10J 3/46
JP 2007091936 A * 4/2007

(Continued)

OTHER PUBLICATIONS

Machine Translation of JP-2009235141-A (Mar. 5, 2026) (Year: 2026).*

(Continued)

*Primary Examiner* — Matthew J Merkling
(74) *Attorney, Agent, or Firm* — Oliff PLC

(57) ABSTRACT

A biomass gasification furnace provided with an outer tube, an inner tube provided inside the outer tube so that a lower end thereof is located higher than a lower end of the outer tube, and a reactor that heats the outer tube from outside, wherein a combustion air supply portion that supplies combustion air is provided inside the inner tube so as to be spaced from the lower end of the inner tube, a biomass raw material is supplied from above to the inside of the inner tube so as to form an accumulation portion in which the (Continued)

biomass raw material has accumulated from the lower end of the outer tube to a location higher than the combustion air supply portion, a fuel gas is produced in the accumulation portion, and the produced fuel gas is discharged through a space between the inner tube and the outer tube.

10 Claims, 1 Drawing Sheet

(56) References Cited

U.S. PATENT DOCUMENTS

| | | | | |
|---|---|---|---|---|
| 2014/0219874 | A1* | 8/2014 | Potgieter | C10J 3/723 422/111 |
| 2024/0093104 | A1* | 3/2024 | Yamazaki | C10J 3/723 |

FOREIGN PATENT DOCUMENTS

| | | | | | |
|---|---|---|---|---|---|
| JP | 2007-177106 | A | | 7/2007 | |
| JP | 2009235141 | A | * | 10/2009 | |
| WO | WO-03040267 | A2 | * | 5/2003 | C10J 3/26 |
| WO | WO-2005113732 | A1 | * | 12/2005 | C10J 3/42 |
| WO | 2019/008934 | A1 | | 1/2019 | |
| WO | 2021/191925 | A1 | | 9/2021 | |

OTHER PUBLICATIONS

Machine Translation of WO-2005113732-A1 (Year: 2026).*
Machine Translation of JP-2007091936-A (Jun. 24, 2026) (Year: 2026).*
Feb. 28, 2024 Extended Search Report issued in European Patent Application No. 23197200.1.

* cited by examiner

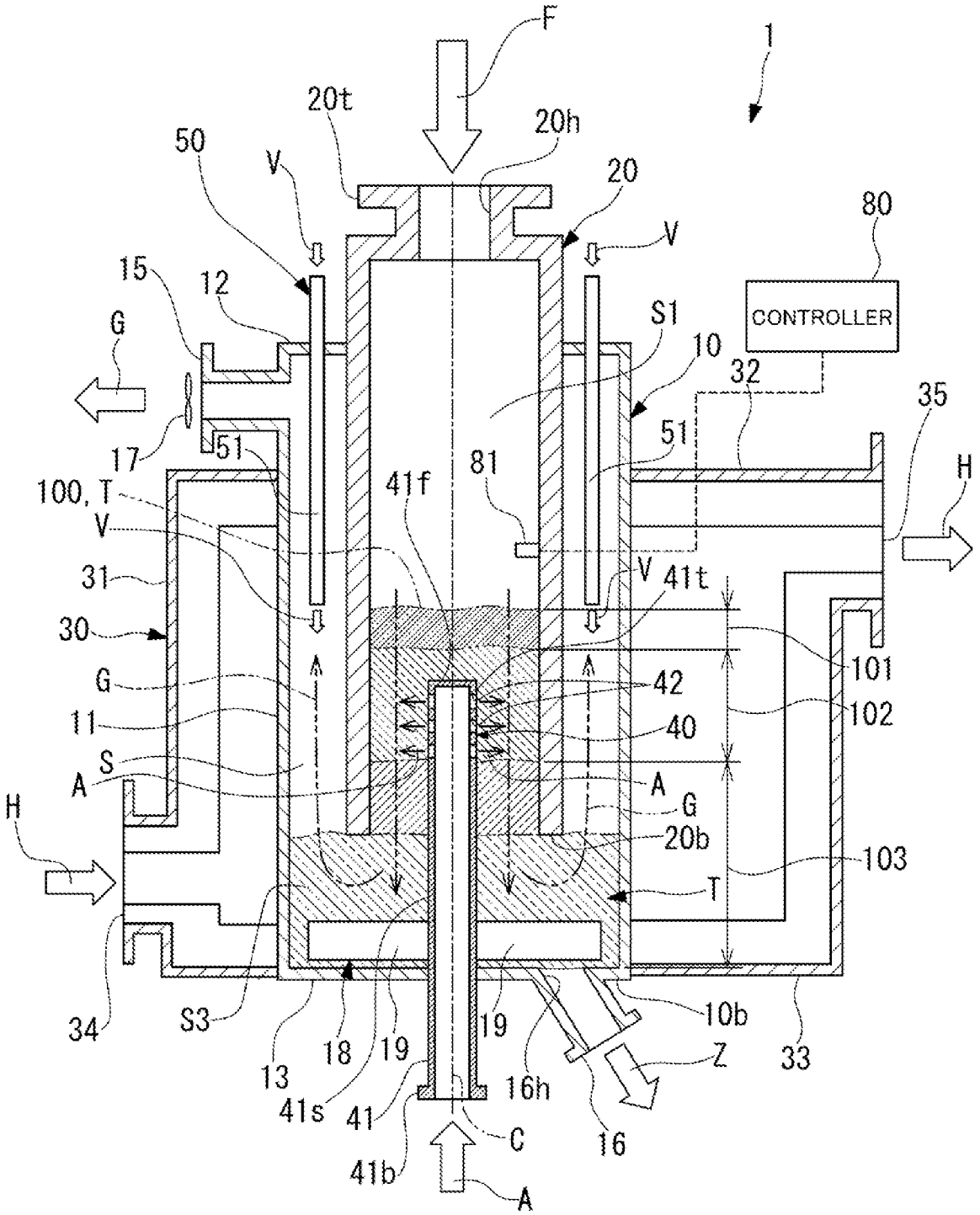
F
1
20t
20h
50
V
20
V
80
CONTROLLER
15
12
S1
10
G
32
35
17
51
51
81
H
100, T
41f
V
V
41t
31
30
101
G
42
102
11
40
S
A
A
G
H
20b
103
T
34
S3
13
18
19
19
10b
Z
33
41s
41
16h
16
C
41b
A

BIOMASS GASIFICATION FURNACE

TECHNICAL FIELD

The present invention relates to a biomass gasification furnace.

BACKGROUND

Fuel gas produced from biomass raw materials is used as gas for the purpose of generating electric power, etc. The fuel gas is generated by heating the biomass raw materials in a biomass gasification furnace to gasify the biomass raw materials.

As such a biomass gasification furnace, for example, Patent Document 1 discloses a structure for a biomass gasification apparatus provided with an externally heated rotary kiln-type pyrolysis portion and a gasification portion. The pyrolysis portion indirectly heats and pyrolyzes the raw material biomass, producing char and pyrolysis gas containing tar components. The gasification portion introduces an oxidizing gas to the char and the pyrolysis gas containing tar components extracted from the pyrolysis portion, thus pyrolyzing the tar components and gasifying the char.

CITATION LIST

Patent Literature

Patent Document 1: JP 2007-177106 A

SUMMARY OF INVENTION

Technical Problem

In the structure in Patent Document 1, when realizing the pyrolysis portion and the gasification portion, these are constructed as separate, independent apparatuses, requiring the facilities to be large.

Additionally, in the gasification portion in the structure in Patent Document 1, heat is not supplied from outside. Therefore, there is a possibility that the production of fuel gas will not be adequately promoted. For this reason, the efficiency of fuel gas production is not high. If heat is to be supplied to the gasification portion in the structure in Patent Document 1, the facilities must be made even larger.

Additionally, in a state in which heat is not externally supplied to the gasification portion, an even larger amount of oxygen is required to decompose the tar components produced in the pyrolysis portion. In the biomass gasification apparatus, the fuel gas that is produced preferably contains a lot of carbon monoxide (CO) and hydrogen ($H_2$). However, if a large amount of oxygen is supplied, then the carbon monoxide and hydrogen can sometimes react with excess oxygen ($O_2$) to produce carbon dioxide ($CO_2$) and water ($H_2O$), thereby reducing the amount of carbon monoxide and hydrogen in the fuel gas. Additionally, by supplying a large amount of oxygen, the oxygen concentration in the fuel gas becomes higher, and the concentrations of carbon monoxide and hydrogen become relatively lower. For this reason, there is a possibility that the heat capacity per unit volume of the fuel gas will be reduced, thereby lowering the quality of the fuel gas.

An objective of the present invention is to provide a biomass gasification furnace that can efficiently produce high-quality fuel gas, and that can be realized with a compact structure.

Solution to Problem

The present invention employs the means indicated below for solving the above-mentioned problem.

Specifically, the biomass gasification furnace of the present invention is a biomass gasification furnace that produces a fuel gas by heating and gasifying a ligneous biomass raw material, and that comprises an outer tube provided so that an axis thereof extends in a vertical direction, an inner tube provided inside the outer tube so that an axis thereof extends in the vertical direction and so that a lower end thereof is located higher than a lower end of the outer tube, and a reactor that heats the outer tube from outside, wherein a combustion air supply portion that supplies combustion air is provided inside the inner tube so as to be spaced from the lower end of the inner tube, the biomass raw material is supplied from above to the inside of the inner tube so as to form an accumulation portion in which the biomass raw material has accumulated from the lower end of the outer tube to a location higher than the combustion air supply portion inside the inner tube, the fuel gas being produced in the accumulation portion, and the fuel gas that has been produced is discharged through a space between the inner tube and the outer tube.

Advantageous Effects of Invention

The present invention can provide a biomass gasification furnace that can efficiently produce high-quality fuel gas, and that can be realized with a compact structure.

BRIEF DESCRIPTION OF DRAWINGS

FIG. 1 is a section view illustrating the structure of a biomass gasification furnace according to an embodiment of the present invention.

DESCRIPTION OF EMBODIMENTS

Hereinafter, embodiments of the present invention will be explained in detail with reference to the drawings.

FIG. 1 shows a section view illustrating the structure of a biomass gasification furnace according to an embodiment of the present invention.

The biomass gasification furnace 1 heats and gasifies a ligneous biomass raw material F to produce a fuel gas G. The biomass gasification furnace 1 is mainly provided with an outer tube 10, an inner tube 20, a reactor 30, a combustion air supply portion 40, a fuel gas adjuster supply portion 50, and a controller 80.

The outer tube 10 is provided so that the axis C thereof extends in the vertical direction. The outer tube 10 is provided, in an integrated manner, with a cylindrical tubular portion 11 extending in the vertical direction along the axis C, a top plate portion 12 closing the upper end of the tubular portion 11, and a bottom plate portion 13 closing the lower end of the tubular portion 11.

The inner tube 20 is provided so as to be spaced radially inward, centered on the axis C, with respect to the outer tube 10. The inner tube 20 is formed with a cylindrical shape such that the axis C thereof extends in the vertical direction. As a result thereof, the outer tube 10 and the inner tube 20 are arranged to have a double tube structure centered on the same axis C. A cylindrical internal space S1 extending in the vertical direction is formed inside the inner tube 20. The lower end 20*b* of the inner tube 20 is provided so as to be located higher than the lower end 10*b* of the outer tube 10.

An upper portion 20*t* of the inner tube 20 penetrates through the top plate 12 of the outer tube 10 and protrudes upward.

An opening 20*h* that opens upward is formed in the upper end of the inner tube 20. The opening 20*h* is a supply port for the biomass raw material F. The biomass gasification furnace 1 is provided with a biomass raw material supply portion that is not illustrated, such as a conveyor, above the opening 20*h*. The biomass raw material F is supplied to the internal space S1 inside the inner tube 20 from above the opening 20*h* by means of the biomass raw material supply portion. The supplied biomass raw material F accumulates between the lower end 10*b* of the outer tube 10 and the lower end 20*b* of the inner tube 20, and inside the inner tube 20, forming an accumulation portion 100.

A rotating pipe 41 is provided inside the inner tube 20. The rotating pipe 41 is provided so as to extend with a tubular shape in the vertical direction along the axis C, centered on the same axis C as the outer tube 10 and the inner tube 20. An upper portion 41*t* of the rotating pipe 41 extends higher than the lower end 20*b* of the inner tube 20 and terminates inside the inner tube 20. The upper end of the rotating pipe 41 is closed by a top plate portion 41*f*. The lower end portion 41*b* of the rotating pipe 41 penetrates through the bottom plate portion 13 of the outer tube 10 and protrudes downward. The rotating pipe 41 is rotationally driven in the circumferential direction about the axis C by a rotation mechanism (not illustrated) equipped with a motor, etc. that is provided below the bottom plate portion 13.

The combustion air supply portion 40 is formed on the upper portion 41*t* of the rotating pipe 41. The combustion air supply portion 40 is provided inside the inner tube 20. The combustion air supply portion 40 has multiple air flow holes 42. The multiple air flow holes 42 are provided so as to be spaced upward from the lower end 20*b* of the inner tube 20. The multiple air flow holes 42 are formed so as to penetrate between the inside and the outside of the rotating pipe 41 at a part that is higher than the lower end 20*b* of the inner tube 20. The multiple air flow holes 42 are provided in a side wall 41*s* of the rotating pipe 41. Combustion air A is fed from the outside into the rotating pipe 41. The combustion air supply portion 40 supplies the combustion air A fed into the rotating pipe 41 from the multiple air flow holes 42 into the accumulation portion 100 on the radially outer side thereof centered on the axis C. By blowing the combustion air A from the combustion air supply portion 40 while rotating the rotating pipe 41 in the circumferential direction about the axis C, the combustion air A can be evenly supplied around the entire circumference within the accumulation portion 100.

As the combustion air A, oxygen (pure oxygen) of high purity is preferably used. Although air may be used as the combustion air A, when nitrogen, large amounts of which are contained in air, is fed into the biomass gasification furnace 1, it can be mixed into the produced fuel gas G without being used in various reactions such as those to be explained below, thereby thinning the fuel gas G. In response thereto, the fuel gas G can be kept from being thinned by increasing the purity of the oxygen used as the combustion air A in the various reactions.

A space S that is ring-shaped when viewed from above is formed between the inner tube 20 and the outer tube 10. This space S extends continuously in the vertical direction from the lower end 20*b* of the inner tube 20 to the top plate portion 12 of the outer tube 10. A bottom space S3 that is circular when viewed from above is formed in a bottom portion inside the outer tube 10 located lower than the lower end 20*b* of the inner tube 20. The bottom space S3 is formed below the internal space S1 and the space S. The internal space S1 and the space S are in communication with each other via the bottom space S3.

In the internal space S1 in the inner tube 20, the fuel gas G produced by the accumulation portion 100 is drawn by the fan 17 to be explained below, thereby being guided through the bottom space S3 to the outer circumferential side, and rises in the space S between the inner tube 20 and the outer tube 10.

The reactor 30 heats the outer tube 10 from the outside. The reactor 30 is formed so as to surround the tubular portion 11 of the outer tube 10 from the radially outer side of the outer tube 10. The reactor 30 has, in an integrated manner, an outer circumferential wall portion 31, an upper wall portion 32, and a bottom wall portion 33. The outer circumferential wall portion 31 is provided so as to be spaced from the tubular portion 11 of the outer tube 10. The outer circumferential wall portion 31 is formed with a tubular shape extending in the vertical direction. The cross-sectional shape of the outer circumferential wall portion 31 when viewed from above may be any shape, such as circular, elliptical, or polygonal. The upper wall portion 32 is arranged to be lower than the upper end of the tubular portion 11 of the outer tube 10. The upper wall portion 32 closes the area between the upper end of the outer circumferential wall portion 31 and the tubular portion 11 of the outer tube 10 from above. The bottom wall portion 33 is arranged to be at about the same height as the bottom plate portion 13 of the outer tube 10. The bottom wall portion 33 closes the area between the lower end of the outer circumferential wall portion 31 and the tubular portion 11 of the outer tube 10 from below. The entire reactor 30 is configured to be covered by a thermal insulator, which is not illustrated.

The reactor 30 is further provided with a fluid inlet 34 and a fluid outlet 35. The fluid inlet 34 is formed in the lower portion of the reactor 30. The fluid inlet 34 feeds, into the reactor 30, a high-temperature fluid H that is supplied from outside the reactor 30. As the high-temperature fluid H, for example, a gas at a temperature of 1000° C. or higher is used. The high-temperature fluid H that is fed from the fluid inlet 34 into the reactor 30 heats the outer tube 10 from the outside. The thermal energy of the high-temperature fluid H that heats the outer tube 10 is also transmitted to the inner tube 20 from the outer tube 10 through the space S by means of radiative heat transfer, etc., thereby heating the inner tube 20 from the outside. The fluid outlet 35 is formed on an upper portion of the reactor 30. The fluid outlet 35 is for discharging the high-temperature fluid H that has been fed into the reactor 30 to the outside of the reactor 30. The excess thermal energy of the high-temperature fluid H after being used for the reaction process, which is discharged from the fluid outlet 35, can be utilized, for example, in an appropriate boiler, heat exchanger, etc.

The outer tube 10 is further provided with a fuel gas discharge portion 15 and an accumulated material discharge portion 16.

The fuel gas discharge portion 15 is formed on the upper side (upper portion) of the outer tube 10 so as to allow communication between the outside of outer tube 10 and the space S between the inner tube 20 and the outer tube 10. The fuel gas discharge portion 15 discharges the fuel gas G in the space S to the outside of the outer tube 10. A fan 17 is provided outside the fuel gas discharge portion 15. The fan 17 is rotationally driven by a drive source (not illustrated) such as a motor. The fan 17 is provided so as to create negative pressure in the space S, thereby drawing the fuel gas G into the space S and guiding the fuel gas G to the fuel gas discharge portion 15. Due to this structure, the fuel gas G is discharged through the space S between the inner tube 20 and the outer tube 10. More specifically, the fuel gas G is discharged after being guided upward through the space S between the inner tube 20 and the outer tube 10.

The fuel gas discharge portion 15 is connected to an external duct (not illustrated). The fuel gas G discharged from the fuel gas discharge portion 15 to the duct is subjected to dust removal with a high-temperature filter, and is cooled by a gas cooler, for example, to 40° C. or lower. The fuel gas G that has been cooled is supplied to an appropriate downstream facility such as an internal combustion engine.

The accumulated matter discharge portion 16 is provided at the lower end 10*b* of the outer tube 10. The accumulated matter discharge portion 16 has a tubular shape extending diagonally downward from the bottom plate portion 13 of the outer tube 10. The accumulated matter discharge portion 16 has an upper-end opening 16*h*. The upper-end opening 16*h* opens upward, inside the outer tube 10, in the bottom plate portion 13. The accumulated matter T located at the lower end of the accumulation portion 100 is discharged, as discharged matter Z, to the outside of the outer tube 10 through the accumulated matter discharge portion 16.

The biomass gasification furnace 1 is provided with a discharge promotion portion 18 at the lower end (bottom portion) inside the outer tube 10. The discharge promotion portion 18 guides the accumulated matter T located at the lower end (bottom portion) inside the outer tube 10 to the accumulated matter discharge portion 16, thereby promoting the discharge of the accumulated matter T through the accumulated matter discharge portion 16. This discharge promotion portion 18 has, for example, turning blades 19 joined to the outer circumferential surface of the rotating pipe 41. The turning blades 19 extend radially outward, centered on the axis C, from the outer circumferential surface of the rotating pipe 41. Multiple (for example, four) turning blades 19 are arranged in the circumferential direction, centered on the axis C. As will be explained below, the accumulated matter T is in a carbonized and fluidized state at the lower end of the accumulation portion 100. The turning blades 19 rotate in the circumferential direction about the axis C, unitarily with the rotating pipe 41, thereby pushing the accumulated matter T that is in the fluidized state downward at the bottom portion inside the outer tube 10. The accumulated matter T that has been pushed downward passes through the upper end opening 16*h* and the accumulated matter discharge portion 16, and is discharged to the outside of the outer tube 10.

The fuel gas adjuster supply portion 50 supplies an adjuster V to the space S between the inner tube 20 and the outer tube 10. The fuel gas adjuster supply portion 50 is provided with multiple supply tubes 51. The multiple supply tubes 51 are arranged so as to be spaced in the circumferential direction about the axis C in the space S between the inner tube 20 and the outer tube 10. Each supply tube 51 extends in the vertical direction, penetrates through the top plate portion 12 of the outer tube 10, downward from above, so as to extend into the space S. Each supply tube 51 is fed the adjuster V from an adjuster supply source (not illustrated) provided outside the outer tube 10. The adjuster V fed to each supply tube 51 is ejected, downward from above, from the lower end of the supply tube 51, into the space S between the inner tube 20 and the outer tube 10.

As the adjuster V, for example, one or both of an oxidizer and a modifier of the fuel gas G is used. The oxidizer mainly promotes the oxidation of the tar components contained in the fuel gas G inside the space S. As the oxidizer, combustion air A similar to that supplied by the combustion air supply portion 40 may be used. The modifier of the fuel gas G increases the amounts of carbon monoxide and hydrogen contained in the fuel gas G, thereby improving the quality of the fuel gas G. As the modifier, for example, superheated steam may be used.

The controller 80 controls the operations of the biomass gasification furnace 1. The biomass gasification furnace 1 is provided with a sensor 81. The sensor 81 detects the height of the accumulation portion 100, i.e., the position of the upper end of the accumulation portion 100, inside the inner tube 20. The controller 80 controls the operations of the biomass raw material supply portion and the discharge promotion portion 18 based on the height of the accumulation portion 100 detected by the sensor 81. When the height of the accumulation portion 100 detected by the sensor 81 is less than or equal to a prescribed height threshold value located higher than the combustion air supply portion 40, the controller 80 stops the discharge promotion portion 18 and supplies the biomass raw material F from the biomass raw material supply portion. When the height of the accumulated matter T detected by the sensor 81 is higher than the height threshold value, the controller 80 stops the supply of the biomass raw material F from the biomass raw material supply portion and activates the discharge promotion portion 18.

In this biomass gasification furnace 1, the biomass raw material F is supplied from above the opening 20*h*. The biomass raw material F is, for example, a ligneous material such as branches and leaves, or tree bark. The biomass raw material F is finely pulverized before being supplied to the biomass gasification furnace 1. The biomass raw material F may be of any size as long as it can be supplied through the opening 20*h*. The biomass raw material F, if in granular form, may be a material having a grain size of, for example, approximately 50 mm, which is generally used for papermaking. However, the finer the biomass raw material F becomes, the greater the overall surface area becomes, thus increasing the production efficiency of the fuel gas G. Therefore, the biomass raw material F should preferably have a grain size distribution such that, for example, grains with a grain size of approximately 10 mm are most prevalent. Additionally, if the material is in the form of so-called pin chips having a long, thin shape, the maximum length should preferably be approximately 50 mm.

The biomass raw material F supplied through the opening 20*h* to the internal space S1 inside the inner tube 20 accumulates in the bottom space S3 between the lower end 10*b* of the outer tube 10 and the lower end 20*b* of the inner tube 20, and in the internal space S1 in the inner tube 20, thereby forming the accumulation portion 100.

The accumulation portion 100 accumulates from the bottom plate portion 13 of the outer tube 10 to a location higher than the upper end of the rotating pipe 41 of the combustion air supply portion 40. The accumulation portion 100 is formed by the sequential stratification of parts in which different reactions occur, i.e., a pyrolysis layer 101, an oxidation layer 102, and a reduction layer 103, from top to bottom. The accumulated matter T located in the lower end of the accumulation portion 100 inside the outer tube 10 is guided by the discharge promotion portion 18 to the accumulated matter discharge portion 16, and is sequentially discharged to the outside of the outer tube 10. As a result thereof, the accumulated matter T forming the accumulation portion 100 sequentially descends (settles) downward from above. As the height of the accumulation portion 100 decreases in association therewith, the biomass raw material F is supplied from the biomass raw material supply portion. In this way, the biomass raw material F supplied to the internal space S1 inside the inner tube 20 is discharged after passing sequentially through the pyrolysis layer 101, the oxidation layer 102, and the reduction layer 103.

The space S between the inner tube 20 and the outer tube 10, the internal space S1 inside the inner tube 20, and the bottom space S3 are heated by the heat of the high-temperature fluid H, which has a temperature of, for example, 1000° C. or higher, supplied to the reactor 30.

The pyrolysis layer 101 is a part of the accumulation portion 100 that is higher than the combustion air supply portion 40. In the pyrolysis layer 101, the biomass raw material F is heated, for example, to approximately 400° C. by the transfer of heat from the high-temperature fluid H, and is thus dried and pyrolyzed. Due to the biomass raw material F being pyrolyzed, a product containing carbon (C), carbon monoxide (CO), hydrogen ($H_2$), etc. is produced. As the product containing carbon, for example, methane ($CH_4$), ethane ($C_2H_6$), etc. is produced.

Additionally, the product containing carbon includes tar components, which are high-molecular-weight hydrocarbons. The tar components, when cooled and liquefied, become viscous. For this reason, when large quantities of tar components are contained in the fuel gas G produced by the biomass gasification furnace 1, there is a possibility, for example, of tar components adhering to machine driving portions of latter-stage equipment in which the fuel gas G is used, thereby causing operational defects in the machine driving portions. Therefore, the amount of tar components contained in the fuel gas G is preferably small.

The oxidation layer 102 is formed below the pyrolysis layer 101. The oxidation layer 102 is formed so as to include a part in which the combustion air supply portion 40 is provided in the vertical direction. In the oxidation layer 102, the combustion air A is supplied to the accumulation portion 100 through the multiple air flow holes 42 in the combustion air supply portion 40. The various components produced by pyrolysis in the pyrolysis layer 101 pass through this oxidation layer 102 in the process of the accumulated matter T settling downward from above in the oxidation layer 102. In the oxidation layer 102, the products containing carbon, such as the tar components, among the various types of components undergo an oxidation reaction due to the oxygen in the combustion air A that has been supplied.

The carbon (C) contained in the tar components, etc. undergo chemical reactions, as in equations (1) and (2) below, due to the oxidation reactions in the oxidation layer 102.

[Equation 1]

$$C+O_2 \rightarrow CO_2+394\ (kJ) \quad (1)$$

[Equation 2]

$$C+(1/2)O_2 \rightarrow CO+123\ (kJ) \quad (2)$$

In the reaction in Equation (1), carbon (C) is oxidized to produce carbon dioxide ($CO_2$), releasing 394 kJ of thermal energy. Additionally, in the reaction in Equation (2) above, carbon (C) is oxidized to produce flammable carbon monoxide (CO), releasing 123 kJ or thermal energy. In this way, due to oxidation reactions in the oxidation layer 102, products containing carbon, such as tar components, are decomposed to gaseous components such as carbon dioxide and carbon monoxide.

Additionally, in the oxidation layer 102, due to an oxidation reaction of hydrogen ($H_2$) produced in the pyrolysis layer, steam ($H_2O$) is produced as in Equation (3) below, releasing 286 kJ of thermal energy.

[Equation 3]

$$H_2+(1/2)O_2 \rightarrow H_2O+286\ (kJ) \quad (3)$$

The oxidation layer 102 has a high temperature, for example, of approximately 1200° C. due to the heat supplied as the combustion air A and the thermal energy released by the reactions of Equations (1) to (3) above.

The reduction layer 103 is formed below the oxidation layer 102. The reduction layer 103 is formed in a part lower than the combustion air supply portion 40. In the reduction layer 103, carbon monoxide (CO) and hydrogen ($H_2$), which are the main components of the fuel gas G, are produced by a gasification reaction.

In the reduction layer 103, carbon (C) components that did not react in the oxidation layer 102 are reduced, as in Equation (4) below, by the carbon dioxide produced in the oxidation layer 102, thereby producing flammable carbon monoxide (CO).

[Equation 4]

$$C+CO_2 \rightarrow 2CO-172\ (kJ) \quad (4)$$

Additionally, in the reduction layer 103, the carbon (C) components that did not react in the oxidation layer 102 are reduced, as in Equation (5) below, by the steam produced in the oxidation layer 102, and water, etc. originally contained in the biomass raw material F, thereby producing flammable carbon monoxide (CO) and hydrogen ($H_2$).

[Equation 5]

$$C+H_2O \rightarrow CO+H_2-131\ (kJ) \quad (5)$$

Regarding the steam (water) in Equation (5) above, when superheated steam is supplied as the adjuster V in the fuel gas adjuster supply portion 50, this superheated steam may also be used.

The above Equations (4) and (5) represent endothermic reactions that absorb heat. This absorbed heat is compensated by the heat released in the oxidation layer 102, etc.

In this way, the fuel gas G is produced by the biomass raw material F passing sequentially through the pyrolysis layer 101, the oxidation layer 102, and the reduction layer 103. The produced fuel gas G contains carbon monoxide (CO) obtained in the oxidation layer 102 by Equation (2) above, and carbon monoxide (CO) and hydrogen ($H_2$) obtained in the reduction layer 103 by Equations (4) and (5) above. The fuel gas G preferably contains large amounts of such carbon monoxide (CO) and hydrogen ($H_2$), which are flammable.

The fuel gas G that has been produced is drawn by the fan 17, thereby being guided to the radially outer side at the lower end portion of the accumulated matter T of the accumulation portion 100 and rising upward from below through the space S between the inner tube 20 and the outer tube 10. During this process, the fuel gas G undergoes reactions such as decomposition of the tar components, as in the oxidation reaction in the oxidation layer 102, and production of carbon monoxide (CO) and hydrogen ($H_2$), as in the reduction reaction in the reduction layer 103, due to the heat from the reactor 30.

The space S between the inner tube 20 and the outer tube 10 is fed the adjuster V from the multiple supply tubes 51 in the fuel gas adjuster supply portion 50. The adjuster V is ejected downward from above, from the lower ends of the supply tubes 51, into the space S between the inner tube 20 and the outer tube 10.

When an oxidizer is used as the adjuster V, the oxidizer and the tar components contained in the fuel gas G rising upward from below inside the space S undergo oxidation reactions as indicated by Equations (1) and (2) above, thereby promoting the decomposition of the tar components.

Additionally, when superheated steam (modifier) is used as the adjuster V, carbon monoxide and hydrogen are produced by a reaction as indicated by Equation (5) above. As a result thereof, the amounts of carbon monoxide and hydrogen contained in the fuel gas G increase thereby improving the quality of the fuel gas G.

As a result of passing sequentially through the pyrolysis layer 101, the oxidation layer 102, and the reduction layer 103, and undergoing the reactions corresponding to each layer, the accumulated matter T located at the lower end of the accumulation portion 100 is in a carbonized and fluidized state. The discharge promotion portion 18 pushes the accumulated matter T that is in the fluidized state downward, through the accumulated matter discharge portion 16, so as to be discharged to the outside of the outer tube 10.

As a result thereof, the entire accumulation portion 100 moves lower. By repeating this process, the biomass raw material F that has been supplied moves sequentially through the pyrolysis layer 101, the oxidation layer 102, and the reduction layer 103.

When the entire accumulation portion 100 moves downward, the height of the accumulation portion 100 becomes lower. The sensor 81 continually detects the height of the accumulation portion 100, and when the height of the accumulation portion 100 becomes equal to or lower than the prescribed height threshold value, the controller 80 stops the discharge promotion portion 18 to stop the discharge of the accumulated matter T, and also supplies the biomass raw material F from the biomass raw material supply portion until the height of the accumulation portion 100 becomes equal to or higher than the prescribed height threshold value. When the height of the accumulation portion 100 exceeds a prescribed height threshold value, the controller 80 stops the supply of the biomass raw material F from the biomass raw material supply portion and activates the discharge promotion portion 18 to discharge the accumulated matter T.

The biomass gasification furnace 1 as described above is a biomass gasification furnace 1 that generates a fuel gas G by heating and gasifying a ligneous biomass raw material F. The biomass gasification furnace 1 is provided with an outer tube 10 provided so that an axis C thereof extends in a vertical direction, an inner tube 20 provided inside the outer tube 10 so that an axis C thereof extends in the vertical direction and so that a lower end 20*b* thereof is located higher than a lower end 10*b* of the outer tube 10, and a reactor 30 that heats the outer tube 10 from outside. A combustion air supply portion 40 that supplies combustion air A is provided inside the inner tube 20 so as to be spaced from the lower end 20*b* of the inner tube 20. The biomass raw material F is supplied from above to the inside of the inner tube 20 so as to form an accumulation portion 100 in which the biomass raw material F has accumulated from the lower end 10*b* of the outer tube 10 to a location higher than the combustion air supply portion 40 inside the inner tube 20, and the fuel gas G is produced in this accumulation portion 100. The fuel gas G that has been produced is discharged through a space S between the inner tube 20 and the outer tube 10.

According to this biomass gasification furnace 1, the biomass raw material F is supplied from above to the inside of the inner tube 20. The biomass raw material F that has been supplied forms the accumulation portion 100 by accumulating from the lower end 10*b* of the outer tube 10 to a location higher than the combustion air supply portion 40 inside the inner tube 20. In this case, the accumulation portion 100 is supplied with ample heat by the reactor 30 provided on the outside of the outer tube 10. As a result thereof, the biomass raw material F is pyrolyzed to produce products containing carbon, as well as carbon monoxide and hydrogen, in a part of the accumulation portion 100 located higher than the combustion air supply portion 40, in which little time has passed since the biomass raw material F was supplied. During pyrolysis, tar components are also produced as the products containing carbon. In a part in which the combustion air supply portion 40 is provided, lower than the part in which pyrolysis is performed, an oxidation reaction occurs due to oxygen contained in the combustion air supplied from the combustion air supply portion 40. Due to this oxidation reaction, products containing carbon, such as tar components, produced by pyrolysis are decomposed to produce carbon monoxide, carbon dioxide, water, etc. Furthermore, in the part lower than the combustion air supply portion 40, a reduction reaction occurs to reduce the carbon dioxide and water produced in the manner described above. Due to this reduction reaction, carbon monoxide and hydrogen, which are the main components of the fuel gas G, are produced.

The accumulation portion 100 in which the reactions progress as described above is provided mainly in the interior of the inner tube 20. The inner tube 20 is heated by the reactor 30 from the outside, with the outer tube 10 therebetween. For this reason, the efficiency by which the fuel gas G is produced is increased in the accumulation portion 100 in the interior of the inner tube 20.

Additionally, since the accumulation portion 100 is heated to increase the efficiency of the reactions, the amount of oxygen required for the reactions is suppressed. Therefore, the amount of combustion air A supplied from the combustion air supply portion 40 can be suppressed. As a result thereof, the carbon monoxide and hydrogen that are the main components of the fuel gas G that is produced are kept from being lost by reacting excessively with oxygen. Thus, reductions in quality of the fuel gas G can be suppressed.

Furthermore, the fuel gas G that is produced, after passing from the accumulation portion 100 between the lower end 20*b* of the inner tube 20 and the lower end 10*b* of the outer tube 10, is discharged through the space S between the inner tube 20 and the outer tube 10. During this process also, the fuel gas G is heated by the reactor 30 provided on the outside of the outer tube 10. As a result thereof, decomposition of the tar components, etc. in the fuel gas G is promoted, and the quality of the fuel gas is improved.

The effects above synergize, allowing a high-quality fuel gas G to be efficiently produced.

Additionally, the inner tube 20 and the outer tube 10 form a double-tube structure, and all of the various types of reactions for producing the fuel gas G are performed inside the double-tube structure. For this reason, there is no particular need to provide any sort of additional facilities relating to the production of the fuel gas G outside the biomass gasification furnace 1. Thus, the structure of the biomass gasification furnace 1 can be made simple and compact.

As a result thereof, it is possible to provide a biomass gasification furnace 1 that can efficiently produce high-quality fuel gas G, and that can be realized with a compact structure.

In general, the methods for producing a fuel gas G by causing combustion of a biomass raw material F can be largely divided between partial combustion gasification and externally heated gasification.

Partial combustion gasification is a method in which a biomass raw material F is provided in a container and some of the biomass raw material F is combusted so that the heat thereof causes gasification. In partial combustion gasification, the tar components contained in the fuel gas G are reduced. However, since the natural heat from the biomass raw material F is used, a biomass raw material F in which the size and the quality, such as the water content, has been adjusted becomes necessary.

Externally heated gasification is a method in which heat is externally applied to a biomass raw material F provided in a container to cause gasification. In externally heated gasification, a fuel gas G with high heat capacity per unit volume can be produced regardless of the quality of the biomass raw material F. However, large amounts of tar components are contained in the fuel gas G. Additionally, with externally heated gasification, the facilities tend to be large.

In contrast therewith, the biomass gasification furnace 1 explained as the present embodiment is configured so as to have both the characteristics of partial combustion gasification, in that heat is applied from inside the biomass raw material F by the heat from the combustion air supply portion 40, and the characteristics of externally heated gasification, in that heat is applied from outside the biomass raw material F by the heat from the reactor 30. As a result thereof, as described above, high-quality fuel gas G can be efficiently produced, and the invention can be realized with a compact structure.

Additionally, the fuel gas G that has been produced is discharged after being guided upward through the space S between the inner tube 20 and the outer tube 10.

With such a feature, the fuel gas G, when being discharged to the outside, is guided upward through the space S between the inner tube 20 and the outer tube 10. For this reason, even if foreign substances such as soot or dust are mixed in the fuel gas G, the foreign substances naturally fall downward, so that the foreign substances can be easily separated from the fuel gas G. Due to this feature, mixing foreign substances into the fuel gas G can be suppressed.

Additionally, the fuel gas G is guided upward through the space S between the inner tube 20 and the outer tube 10, and at this time also, the fuel gas G is heated by the reactor 30 provided on the outside of the outer tube 10. Due to this feature, the fuel gas G is heated for a longer time, thereby promoting the decomposition of tar components, etc. in the fuel gas G, so that the quality of the fuel gas G is improved.

Additionally, the biomass gasification furnace 1 is further provided with a fuel gas adjuster supply portion 50 that supplies, as an adjuster V, one or both of an oxidizer and a modifier of the fuel gas G, downward from above, into the space S between the inner tube 20 and the outer tube 10.

Due to this feature, by supplying the adjuster V downward from above into the space S between the inner tube 20 and the outer tube 10 by means of the fuel gas adjuster supply portion 50, foreign substances contained in the fuel gas G guided upward in the space S can be kept from rising together with the fuel gas G. For this reason, mixing foreign substances into the fuel gas G can be more reliably suppressed.

Additionally, when the adjuster is an oxidizer, the oxidative decomposition of the tar components in the fuel gas G can be promoted. Additionally, when the adjuster is a modifier, the fuel gas G can be modified, thereby increasing the quality of the fuel gas G.

Additionally, a part of the accumulation portion 100 that is higher than the combustion air supply portion 40 is a pyrolysis layer 101 in which the biomass raw material F is pyrolyzed. A part of the accumulation portion 100 in which the combustion air supply portion 40 is provided is an oxidation layer 102 in which tar components produced by pyrolysis are decomposed by oxidation reactions. A part of the accumulation portion 100 lower than the combustion air supply portion 40 is a reduction layer 103 in which carbon dioxide and steam produced in the pyrolysis layer 101 and the oxidation layer 102 are reduced to produce the fuel gas G containing carbon monoxide and hydrogen.

Due to this feature, the biomass raw material F is pyrolyzed in the pyrolysis layer 101 in the accumulation portion 100. The tar components produced by pyrolysis of the biomass raw material F are decomposed by oxidation reactions in the oxidation layer 102 below the pyrolysis layer 101. Carbon dioxide and steam are produced in the pyrolysis layer 101 and the oxidation layer 102. From the carbon dioxide and the steam that are produced, carbon monoxide and hydrogen are produced by a reduction reaction in the reduction layer 103 below the oxidation layer 102. As a result thereof, the fuel gas G containing carbon monoxide and hydrogen is produced.

Additionally, the biomass gasification furnace 1 is further provided with an accumulated matter discharge portion 16, provided at the lower end 10*b* of the outer tube 10, through which the accumulated matter T located at the lower end of the accumulation portion 100 is discharged, and a discharge promotion portion 18, provided at the lower end 10*b* of the outer tube 10, which promotes discharge by guiding the accumulated matter T located at the lower end to the accumulated matter discharge portion 16.

Due to this feature, the accumulated matter T located at the lower end of the accumulation portion 100 is guided to the accumulated matter discharge portion 16 by the discharge promotion portion 18. The accumulated matter T that has been guided is discharged to the outside of the outer tube 10 from the accumulated matter discharge portion 16. As a result thereof, the accumulated matter T in the accumulation portion 100 can sequentially settle downward while undergoing a pyrolysis reaction, an oxidation reaction, and a reduction reaction.

Additionally, the biomass gasification furnace 1 is provided with a sensor 81 that detects the height of the accumulation portion 100. Moreover, the biomass gasification furnace 1 is provided with a controller 80 that stops the discharge promotion portion 18 when the height of the accumulation portion 100 is equal to or lower than a height threshold value located higher than the combustion air supply portion 40, and that activates the discharge promotion portion 18 when the height of the accumulation portion 100 is higher than the height threshold value.

Due to this feature, by stopping the discharge promotion portion 18 when the height of the accumulation portion 100 is equal to or less than the height threshold value, the accumulated matter T can be kept from being discharged from the accumulated matter discharge portion 16 in a state in which the height of the accumulation portion 100 is not sufficient and there is not enough accumulated matter T to produce the fuel gas G.

Since the height of the accumulation portion 100 is maintained in this way, the pyrolysis layer 101, the oxidation layer 102, and the reduction layer 103 are continually formed in the accumulation portion 100, and in each of these layers, the corresponding reaction can constantly progress without interruption.

Additionally, the biomass gasification furnace 1 is further provided with a fuel gas discharge portion 15, provided on an upper side of the outer tube 10, that discharges the fuel gas G guided upwards to the outside, and a fan 17, provided outside the fuel gas discharge portion 15, so as to guide the fuel gas G to the fuel gas discharge portion 15.

Due to this feature, the fuel gas G guided upward in the outer tube 10 is discharged to the outside of the outer tube 10 by the fuel gas discharge portion 15. The fuel gas G can be efficiently discharged to the outside by guiding the fuel gas G to the fuel gas discharge portion 15 by means of the fan 17.

Additionally, a rotating pipe 41 is provided so as to extend in the form of a tube in the vertical direction along the axis C inside the inner tube 20, and so as to rotate in the circumferential direction about the axis C, the upper end of the rotating pipe 41 being closed. The combustion air supply portion 40 is provided with multiple air flow holes 42 formed so as to allow communication between the outside and the inside of the rotating pipe 41 in a side wall 41*s* of the rotating pipe 41. The combustion air A is fed from the outside into the rotating pipe 41, and is supplied to the accumulation portion 100 through the multiple air flow holes 42.

Due to this feature, multiple air flow holes 42 are formed in the side wall 41*s* of the rotating pipe 41, which is provided so as to extend in the form of a tube in the vertical direction along the axis C and so as to rotate in the circumferential direction about the axis C, and the combustion air A is supplied to the accumulation portion 100 through the multiple air flow holes 42, thereby allowing the combustion air A to be thoroughly supplied around the periphery of the combustion air supply portion 40.

Additionally, the multiple air flow holes 42 are formed in the side wall 41*s* of the rotating pipe 41.

If the multiple air flow holes 42 were provided in the top plate portion 41*f* closing the upper end of the rotating pipe 41 so that the combustion air A is supplied upward from the rotating pipe 41, then there is a possibility that the flow of the combustion air A could disturb the boundary between the pyrolysis layer 101 and the oxidation layer 102, and that the reactions of the respective layers are not adequately performed.

In contrast therewith, according to the structure described above, since the multiple air flow holes 42 are formed in the side wall 41*s* of the rotating pipe 41, the boundary between the pyrolysis layer 101 and the oxidation layer 102 is kept from being disturbed, so that the reactions of the respective layers can be stably performed.

The invention claimed is:

1. A biomass gasification furnace that produces a fuel gas by heating and gasifying a ligneous biomass raw material, the biomass gasification furnace comprising:

an outer tube provided so that an axis thereof extends in a vertical direction;

an inner tube provided inside the outer tube so that an axis thereof extends in the vertical direction and so that a lower end thereof is located higher than a lower end of the outer tube;

a rotating pipe provided inside the inner tube so that an axis thereof extends in the vertical direction, the rotating pipe being configured to be rotationally driven in a circumferential direction about the axis; and a reactor that is configured to heat the outer tube from outside, wherein the rotating pipe includes a cylindrical side wall, a top plate portion that closes an upper end of the cylindrical side wall, and an air flow hole that allows communication between an inside and an outside of the rotating pipe, the rotating pipe is configured to receive combustion air fed into the rotating pipe from the outside, the inner tube is configured to receive the biomass raw material is supplied from above to the inside of the inner tube so as to form an accumulation portion in which the biomass raw material has accumulated from the lower end of the outer tube to a location higher than the air flow hole of the rotating pipe inside the inner tube, the biomass gasification furnace is configured to produce the fuel gas in the accumulation portion, and discharge the fuel gas that has been produced through a space between the inner tube and the outer tube, and the air flow hole is provided only in the cylindrical side wall and is configured to supply the combustion air into the accumulation portion on a radially outer side of the rotating pipe centered on the axis.

2. The biomass gasification furnace according to claim 1, wherein the biomass gasification furnace is configured to discharge the fuel gas that has been produced after being guided upward through the space between the inner tube and the outer tube.

3. The biomass gasification furnace according to claim 2, further comprising a fuel gas adjuster supply portion that is configured to supply, as an adjuster, one or both of an oxidizer and a modifier of the fuel gas, downward from above, into the space between the inner tube and the outer tube.

4. The biomass gasification furnace according to claim 1, wherein:

a part of the accumulation portion that is higher than the air flow hole of the rotating pipe is a pyrolysis layer in which the biomass raw material is pyrolyzed;

a part of the accumulation portion that covers the air flow hole of the rotating pipe is an oxidation layer in which tar components produced by pyrolysis are decomposed by an oxidation reaction; and a part of the accumulation portion that is lower than the air flow hole of the rotating pipe is a reduction layer in which carbon dioxide and steam produced in the pyrolysis layer and in the oxidation layer are reduced to produce the fuel gas containing carbon monoxide and hydrogen.

5. The biomass gasification furnace according to claim 1, further comprising:

an accumulated matter discharge portion that is provided at the lower end of the outer tube and is configured to discharge the accumulated matter located at the lower end of the accumulation portion; and a discharge promotion portion that is provided at the lower end of the outer tube and is configured to promote discharge by guiding the accumulated matter located at the lower end to the accumulated matter discharge portion.

6. The biomass gasification furnace according to claim 5, further comprising:

a sensor configured to detect a height of the accumulation portion; and a controller configured to:

stop the discharge promotion portion when the height of the accumulation portion is equal to or lower than a height threshold value located higher than the air flow hole of the rotating pipe, and activate the discharge promotion portion when the height of the accumulation portion is higher than the height threshold value.

7. The biomass gasification furnace according to claim 1, further comprising:

a fuel gas discharge portion, provided on an upper side of the outer tube, that is configured to discharge the fuel gas guided upwards to an outside; and a fan, provided outside the fuel gas discharge portion, and configured to guide the fuel gas to the fuel gas discharge portion.

8. The biomass gasification furnace according to claim 1, wherein:

the rotating pipe includes multiple air flow holes including the air flow hole, the multiple air flow holes are configured to supply the combustion air into the accumulation portion on the radially outer side of the rotating pipe centered on the axis, and all of the multiple air flow holes are formed only in the cylindrical side wall of the rotating pipe.

9. The biomass gasification furnace according to claim 1, wherein:

the rotating pipe only includes holes formed in the cylindrical side wall and a lower end portion of the rotating pipe, the lower end portion is formed on an axially opposite side of the rotating pipe from the top plate portion, and includes a lower end hole configured to receive the combustion air from the outside of the rotating pipe, and the cylindrical side wall includes the air flow hole configured to supply the combustion air received from the lower end hole into the accumulation portion on the radially outer side of the rotating pipe centered on the axis.

10. The biomass gasification furnace according to claim 1, wherein the top plate portion of the rotating pipe does not include a hole.

* * * * *